US005949341A

United States Patent [19]

Oliver

[11] Patent Number: 5,949,341

[45] Date of Patent: Sep. 7, 1999

[54] SAFETY SYSTEM FOR A MATERIALS HANDLING DEVICE

[75] Inventor: Geoffrey Ralph Oliver, West Sussex, United Kingdom

[73] Assignee: Jungheinrich (G.B.) Limited, Manchester, United Kingdom

[21] Appl. No.: 08/860,333

[22] PCT Filed: Dec. 22, 1995

[86] PCT No.: PCT/GB95/03037

§ 371 Date: Oct. 21, 1997

§ 102(e) Date: Oct. 21, 1997

[87] PCT Pub. No.: WO96/20027

PCT Pub. Date: Jul. 4, 1996

[30] Foreign Application Priority Data

Dec. 23, 1994 [GB] United Kingdom ..... 9426109

[51] Int. Cl.[6] ..... G08B 21/00

[52] U.S. Cl. ..... 340/626; 340/632; 73/23.2

[58] Field of Search ..... 340/626, 632, 340/633, 634, 500, 511, 825.06; 422/94; 73/23.2, 23.37

[56] References Cited

U.S. PATENT DOCUMENTS

| | | | |
|---|---|---|---|
| 3,831,318 | 8/1974 | Richmond | 340/626 |
| 3,943,775 | 3/1976 | De Baun | 73/432 R |
| 4,069,018 | 1/1978 | Karna et al. | 340/632 |
| 4,517,161 | 5/1985 | Gravina et al. | 422/95 |
| 5,274,356 | 12/1993 | Taricco | 340/626 |

*Primary Examiner*—Jeffery A. Hofsass
*Assistant Examiner*—Anh La
*Attorney, Agent, or Firm*—Panitch Schwarze Jacobs & Nadel, P.C.

[57] ABSTRACT

A safety system (10) for a materials handling device, for example fork lift truck, conveyor, comprises a sensing head (11) linked to a pressurization control unit (12). The sensing head (11) monitors the level of explosive vapors in proximity to the device relative to low explosive level (LEL). When a level of explosive vapors of below 25% LEL are detected, the pressurization control unit (12) maintains the supply of an inert gas for a supply (13) to at least one sealed enclosure which encloses any hazardous components in the device at substantially atmospheric pressure. When a level of explosive vapors above 25% LEL is detected, the pressurization control device (12) is operable to increase the supply of inert gas to the enclosure (14) to being the pressure in the enclosure (14) to greater than atmospheric pressure. With the safety system fitted to the handing device, the device can move freely in areas where the level of explosive vapors is both above and below 25% LEL and the supply of inert gas can be maximised.

13 Claims, 1 Drawing Sheet

SAFETY SYSTEM FOR A MATERIALS HANDLING DEVICE

BACKGROUND OF THE INVENTION

This invention relates to safety system for a materials handling device.

Conventionally, where materials handling devices are to be moved around industrial premises, such as warehouses or factories, it is to be expected, in certain industries, that the device may be required to move through areas in which hazardous substances are present, e.g. explosive vapors. Legislation defines a level at which explosive vapors are present known as a lower explosive level (LEL). Areas in which the level of explosive vapors is less than 25% LEL are generally regarded as safe areas, whereas areas in which the level of explosive vapors is greater than 25% LEL are regarded as hazardous areas. Legislation further defines the level of protection which a materials handling device is expected to have to be able to move around in areas in which the level of explosive vapors is greater than and less than 25% LEL.

In order to comply with the legislation, it is known for materials handling devices such as fork lift trucks, conveyor belts, etc. to have safety systems which are designed to ensure that hazardous; components of the device, such as electronic circuitry which might produce an occasional spark or arc, are isolated from the explosive vapors in areas where such vapors are detected. Generally speaking, these conventional safety systems enclose hazardous components in sealed enclosures which are filled with an inert gas at a pressure greater than atmospheric pressure to prevent explosive vapors reaching the hazardous components of the device. If the pressure is maintained above atmospheric pressure, the device is suitable for use in areas in which the level of explosive vapors are both below or above 25% LEL.

However, these conventional arrangements suffer from the problem that whilst allowing the device to move between areas in which the level of explosive vapors is less than or above 25% LEL they have a relatively short operational time. This arises due to the fact that the devices normally carry on board supplies of inert gas and, if the pressure of inert gas is kept above atmospheric pressure to render the device capable of being used in above 25% LEL conditions, the supply of inert gas is exhausted within a short space of time.

There has been a long felt need for a materials handling device which can move in above and below 25% LEL conditions and which has a reasonably long operational time.

SUMMARY OF THE INVENTION

Accordingly, it is an object of the present invention to provide a safety system for a materials handling device which will enable the device to operate in both above and below 25% LEL conditions and which minimises the use of inert gas to maximise operational time.

According to the present invention therefore there is provided a safety system for a movable materials handling device comprising sensing means which senses the level of explosive vapors in the proximity of the device, control means linked to said sensing means, said control means being operable to determine from the sensed level whether the device is in an area in which there is above or below 25% LEL conditions and to automatically cause any hazardous components in said device to be substantially surrounded by a protective substance at a pressure substantially at atmospheric pressure when the device is in an area with a level less than 25% LEL and to automatically cause the pressure of the protective substance to be increased to be substantially above atmospheric pressure when the device is in an area in which the level is above 25% LEL which prevents said hazardous components coming into contact with said dangerous vapors.

With this arrangement it is possible for a materials handling device to operate in both hazardous areas (in which dangerous substances are present most of the time) e.g. production areas and non-hazardous areas (in which dangerous substances are not normally present and, if they are, they are not present for any significant time) e.g. storage areas.

Preferably said hazardous components are contained substantially within at least one sealed enclosure and said protective substance is introduced into said one or each enclosure.

Preferably said protective substance is an inert or relatively inert gas.

BRIEF DESCRIPTION OF THE DRAWINGS

The invention will now be described further by way of example only and with reference to the accompanying drawing, the single FIGURE of which shows a diagrammatic representation of one form of safety system according to the present invention suitable for use in a materials handling device.

DETAILED DESCRIPTION OF THE INVENTION

Figure 1:
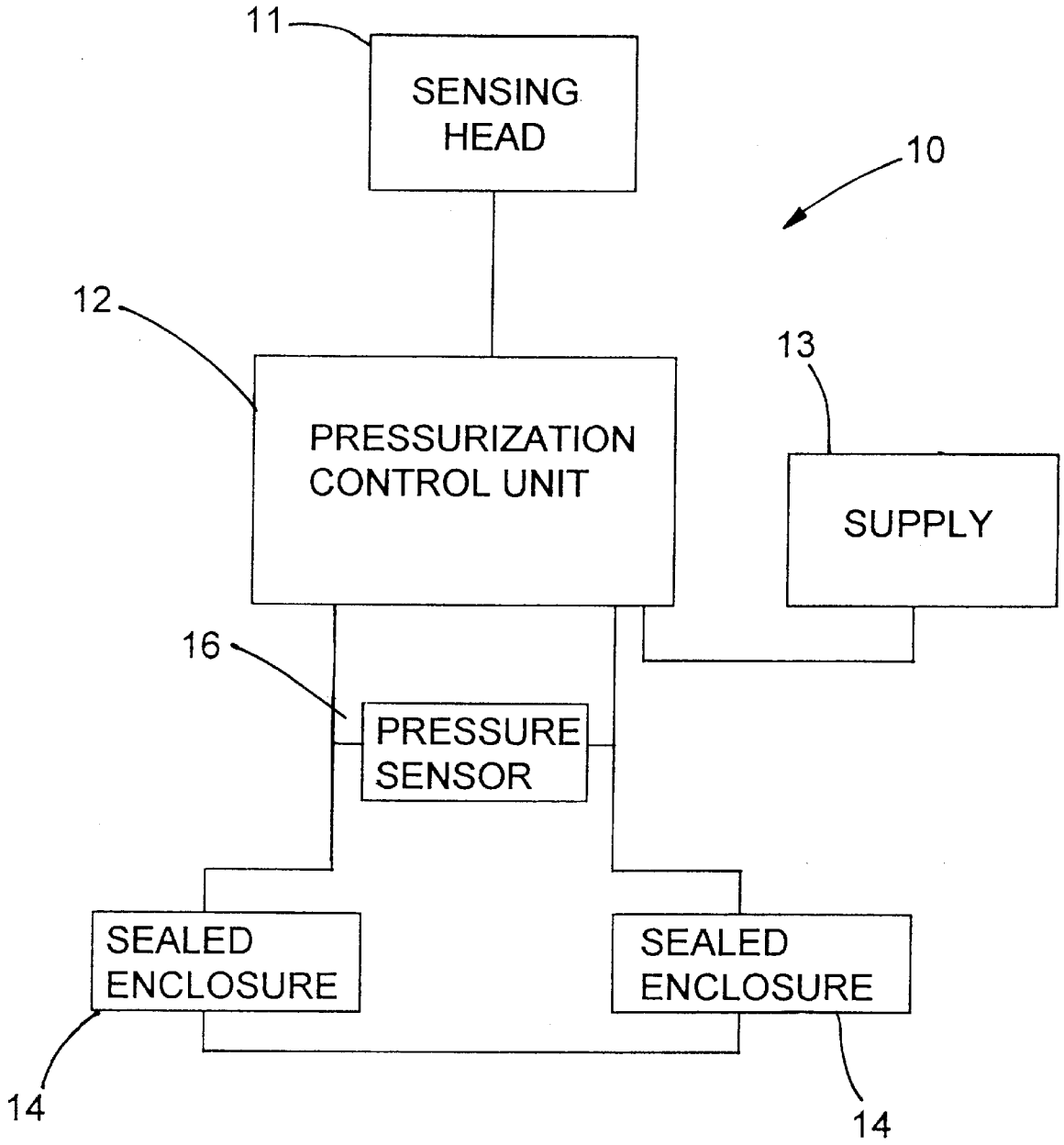

Referring now to the drawing, there is shown one embodiment of safety system in accordance with the present invention. The safety system 10 is particularly suited for use in a materials handling device such as a fork lift truck or conveyor, although it is thought that the system can be used in any suitable device where it is required as desired or as appropriate.

The safety system 10 comprises a sensing head 11 linked to a pressurization control unit 12. The pressurization control unit 12 operates to provide an inert or relatively inert gas from a supply 13 thereof under pressure to one or more sealed enclosures 14 which enclose all hazardous electronic or other components in the materials handling device to which the system is fitted. By hazardous components is meant any component which is capable of producing a spark or other discharge which may ignite or detonate any hazardous substance in the proximity of the device.

The pressurization control unit 12 is connected to the supply 13 of inert or relatively inert gas, which supply may be formed integrally with the device, attached to the device or separate from the device. In one embodiment the inert gas is compressed air, although different inert or relatively inert gases can be used as desired or as appropriate.

In use, when the materials handling device is first actuated for use, the pressurization control unit 12 operates to purge the (or each) enclosure 14 with a known volume of the inert or relatively inert gas. The (or each) enclosure 14 is purged with the gas until approximately five times the internal volume of the (or the total of each) enclosure 14 of gas has passed through the enclosures 14. This is detected by pressure sensors 16 which are disposed in the (or each) supply line of gas from the supply 13 to the (or each) enclosure 14. Once this volume of gas has passed into the enclosures 14, and has been sensed by the pressure sensors 16, the pressurization control unit 12 reduces the flow of gas into the enclosures 14 to a much smaller rate which is known as a standard default setting. Purging of the enclosures 14 with inert gas in this way prior to actuation of the device for use ensures that no hazardous substances are present in the enclosures 14, i.e. in proximity to hazardous components which could present a risk during operation of the device. If desired, the pressurization control unit 12 can be adapted such that operation of the materials handling device cannot be effected until the above purging procedure has been carried out and in this can be incorporated in the pressurization control unit 12 as a truth table.

Furthermore, once the purging of the enclosures 14 mentioned above has been carried out, the device may be adapted to require the presence of the standard default pressure for a predetermined time period in order that the sealing of the enclosures 14 can be verified to be satisfactory before operation, i.e. that the standard default pressure is maintained over the predetermined time period without significant variation.

With the safety system set up as described above the hazardous components (not shown) are surrounded by an amount of inert or relatively inert gas in the (or each) enclosure 14. Accordingly the risk of a dangerous substance in the proximity of the device from coming into contact with the hazardous components is reduced so as to be insignificant, with the pressure of inert gas at the standard default setting, the device is safe for operation in an area where the low explosion level is less than 25% LEL. The standard default setting usually corresponds to a pressure of gas in the enclosures of substantially atmospheric pressure.

When the low explosive level is detected by the sensor as being 25% or greater then the pressurization control unit 12 automatically increases the pressure of the inert gas provided to the (or each) enclosure 14 from the supply 13 to greater than atmospheric in order to prevent any hazardous substances gaining access to the (or each) enclosure 14 and therefore coming into the proximity of the hazardous components thereby causing a risk of ignition or explosion. With the pressure of the inert gas in the (or each) enclosure 14 greater than atmospheric pressure the device is safe for operation in areas in which the level of explosive vapors is greater than 25% LEL. Thus it can be seen that with automatic pressure control in accordance with sensed levels of explosive vapors, the handling device is rendered more versatile insofar as it can move around many different areas in which the level of explosive vapors is both above or below 25% LEL. Furthermore, by accurate control of the presence of the inert gas in the enclosures 14, allows the supply of inert gas to be maximised insofar as use is concerned thereby significantly increasing the operational time of the device which leads to considerable commercial advantage.

It is of course to be understood that the invention is not intended to be restricted to the details of the above embodiment which are described by way of example only.

I claim:

1. A safety system (10) for a movable materials handling device comprising sensing means (11) which senses the level of explosive vapors in the proximity of the device, control means (12) linked to said sensing means, said control means (12) being operable to determine from the sensed level whether the device is in an area in which there is above or below 25% LEL conditions and to automatically cause any hazardous components in said device to be substantially surrounded by a protective substance at a pressure substantially at atmospheric pressure when the device is in an area with a level less than 25% LEL and to automatically cause the pressure of the protective substance to be increased to be substantially above atmospheric pressure when the device is in an area in which the level is above 25% LEL which prevents said hazardous components coming into contact with said explosive vapors.

2. A safety system according to claim 1 wherein said hazardous components are enclosed within at least one sealed enclosure (14), said protective substance being introduced into said one or each enclosure.

3. A safety system according to claim 2 wherein said protective substance is an inert or relatively inert gas.

4. A safety system according to claim 2 wherein said control means (12) comprises a pressurization control device which is linked to a supply of said protective susbstance, said pressurization control device controlling the supply of protective substance from said supply in accordance with sensed levels of explosive vapors.

5. A safety system according to claim 4 wherein prior to use of said handling device, said control device (12) is operable to purge said at least one enclosure with a known volume of said protective substance in order to purge said enclosure of any explosive vapour.

6. A safety system according to claim 5 wherein at least five times the volume of said at least one enclosure (14) of protective substance is introduced into said enclosure.

7. A safety system according to claim 6 wherein said control device (12) is operable to purge said at least one enclosure (14) with a known volume of protective substance and pressure within said enclosure (14) is monitored by said control device (12) for variation over a predetermined period of time to ensure that sealing of the enclosures is adequate.

8. A safety system according to claim 6 wherein said control device (12) is operable to purge said at least one enclosure (14) with a known volume of protective substance and pressure within said enclosure (14) is monitored by said control device (12) for variation over a predetermined period of time to ensure that sealing of the enclosures is adequate.

9. A safety system according to claim 1 wherein said protective substance is an inert or relatively inert gas.

10. A safety system according to claim 9 wherein said protective substance comprises compressed air.

11. A safety system according to claim 10 wherein said control means (12) comprises a pressurization control device which is linked to a supply of said protective susbstance, said pressurization control device controlling the supply of protective substance from said supply in accordance with sensed levels of explosive vapors.

12. A safety system according to claim 9 wherein said control means (12) comprises a pressurization control device which is linked to a supply of said protective susbstance, said pressurization control device controlling the supply of protective substance from said supply in accordance with sensed levels of explosive vapors.

13. A safety system according to claim 1 wherein said control means (12) comprises a pressurization control device which is linked to a supply of said protective substance, said pressurization control device controlling the supply of protective substance from said supply in accordance with sensed levels of explosive vapors.

* * * * *